US010233412B2

(12) United States Patent
Brown et al.

(10) Patent No.: US 10,233,412 B2
(45) **Date of Patent: *Mar. 19, 2019**

(54) AQUEOUS HARD SURFACE CLEANERS BASED ON TERPENES AND FATTY ACID DERIVATIVES

(71) Applicant: STEPAN COMPANY, Northfield, IL (US)

(72) Inventors: Aaron Brown, Chicago, IL (US); Wilma Gorman, Park Ridge, IL (US); Ronald A. Masters, Glenview, IL (US)

(73) Assignee: STEPAN COMPANY, Northfield, IL (US)

( * ) Notice: Subject to any disclaimer, the term of this patent is extended or adjusted under 35 U.S.C. 154(b) by 5 days.

This patent is subject to a terminal disclaimer.

(21) Appl. No.: 15/674,608

(22) Filed: Aug. 11, 2017

(65) Prior Publication Data

US 2017/0342354 A1 Nov. 30, 2017

Related U.S. Application Data

(63) Continuation of application No. 14/395,090, filed as application No. PCT/US2013/036470 on Apr. 12, 2013, now Pat. No. 9,758,751.

(60) Provisional application No. 61/637,593, filed on Apr. 24, 2012.

(51) Int. Cl.

| | |
|---|---|
| ***C11D 1/29*** | (2006.01) |
| ***C11D 3/32*** | (2006.01) |
| ***C11D 3/50*** | (2006.01) |
| ***C11D 3/10*** | (2006.01) |
| ***C11D 11/00*** | (2006.01) |
| ***C11D 17/04*** | (2006.01) |
| ***C11D 1/66*** | (2006.01) |
| ***C11D 1/02*** | (2006.01) |
| ***C11D 3/30*** | (2006.01) |
| ***C11D 1/38*** | (2006.01) |
| ***C11D 3/18*** | (2006.01) |
| ***C11D 3/20*** | (2006.01) |
| ***B43K 29/05*** | (2006.01) |
| ***C11D 1/83*** | (2006.01) |
| ***C11D 1/46*** | (2006.01) |
| ***C11D 1/52*** | (2006.01) |
| ***C11D 1/645*** | (2006.01) |
| ***C11D 1/65*** | (2006.01) |
| ***C11D 1/835*** | (2006.01) |
| ***C11D 1/94*** | (2006.01) |

(52) U.S. Cl.

CPC ..... *C11D 11/0023* (2013.01); *B43K 29/05* (2013.01); *C11D 1/02* (2013.01); *C11D 1/38* (2013.01); *C11D 1/46* (2013.01); *C11D 1/521* (2013.01); *C11D 1/528* (2013.01); *C11D 1/645* (2013.01); *C11D 1/65* (2013.01); *C11D 1/66* (2013.01); *C11D 1/83* (2013.01); *C11D 1/835* (2013.01); *C11D 1/94* (2013.01); *C11D 3/10* (2013.01); *C11D 3/188* (2013.01); *C11D 3/2037* (2013.01); *C11D 3/2062* (2013.01); *C11D 3/30* (2013.01); *C11D 3/32* (2013.01); *C11D 3/50* (2013.01); *C11D 11/0052* (2013.01); *C11D 17/041* (2013.01); *C11D 17/046* (2013.01)

(58) Field of Classification Search

CPC .... C11D 1/02; C11D 1/38; C11D 1/66; C11D 1/83; C11D 3/10; C11D 3/30; C11D 3/50; C11D 17/046; C11D 17/041

USPC ..... 510/101, 238, 245, 264, 421, 422, 424, 510/426, 427, 432, 434, 501, 509

See application file for complete search history.

(56) References Cited

U.S. PATENT DOCUMENTS

| | | | |
|---|---|---|---|
| 3,155,591 | A | 11/1964 | Hiller |
| 3,929,678 | A | 12/1975 | Laughlin et al. |
| 3,959,461 | A | 5/1976 | Bailey et al. |
| 4,275,055 | A | 6/1981 | Nachtigal et al. |
| 4,387,090 | A | 6/1983 | Bach |
| 4,545,941 | A | 10/1985 | Rosenburg |

(Continued)

FOREIGN PATENT DOCUMENTS

| | | |
|---|---|---|
| DE | 19747891 | 5/1999 |
| EP | 1148116 | 10/2001 |

(Continued)

OTHER PUBLICATIONS

G. Djigoue et al., Appl. Catal. A 346 (2009) 158.

(Continued)

*Primary Examiner* — Gregory R Delcotto
(74) *Attorney, Agent, or Firm* — Dilworth IP, LLC

(57) ABSTRACT

Aqueous hard surface cleaner compositions useful for removing permanent ink are disclosed. The compositions comprise 75 to 99 wt. % of water; 0.1 to 5 wt. % of a monoterpene; 0.1 to 5 wt. % of a $C_{10}$-$C_{17}$ fatty acid derivative; and 0.1 to 5 wt. % of one or more surfactants. The fatty acid derivative is selected from N,N-dialkyl amides, N,N-dialkyl esteramines, and N,N-dialkyl amidoamines. Preferably, a base such as sodium carbonate or monoethanolamine is also included. The invention includes concentrates comprising the non-aqueous components recited above, as well as other applications for the cleaners and concentrates such as graffiti removers and permanent ink erasers. The combination of a monoterpene and certain fatty acid derivatives, especially fatty N,N-dialkyl amides, unexpectedly enables even dilute aqueous compositions to rapidly decolorize black permanent marker from hard, non-porous surfaces.

20 Claims, No Drawings

(56) References Cited

U.S. PATENT DOCUMENTS

| | | | | |
|---|---|---|---|---|
| 4,790,951 | A | 12/1988 | Frieser et al. | |
| 5,308,531 | A | 5/1994 | Urfer et al. | |
| 5,346,640 | A | 9/1994 | Leys | |
| 5,575,864 | A | 11/1996 | Haley et al. | |
| 5,591,708 | A | 1/1997 | Richter | |
| 5,614,484 | A | 3/1997 | Panandiker | |
| 5,712,234 | A | 1/1998 | Pourreau | |
| 5,773,091 | A | 6/1998 | Perlman et al. | |
| 5,789,363 | A | 8/1998 | Cala et al. | |
| 5,814,590 | A | 9/1998 | Sherry et al. | |
| 5,837,065 | A | 11/1998 | Haley et al. | |
| 5,866,534 | A | 2/1999 | Gry et al. | |
| 5,929,022 | A | 7/1999 | Velazquez | |
| 5,939,059 | A | 8/1999 | Franklin et al. | |
| 6,057,283 | A | 5/2000 | Oftring et al. | |
| 6,153,566 | A | 11/2000 | Yonekura et al. | |
| 6,191,094 | B1 | 1/2001 | Cala et al. | |
| 6,281,178 | B1 | 8/2001 | Ryklin et al. | |
| 6,284,723 | B1 | 9/2001 | Zhou et al. | |
| 6,399,553 | B1 | 6/2002 | Cable et al. | |
| 6,465,411 | B2 | 10/2002 | Manske | |
| 6,489,285 | B2 | 12/2002 | Faber | |
| 6,511,953 | B1 | 1/2003 | Fontana et al. | |
| 6,528,070 | B1 | 3/2003 | Bratescu | |
| 6,528,477 | B2 | 3/2003 | Kasturi et al. | |
| 6,605,584 | B2 | 8/2003 | Fong et al. | |
| 6,797,684 | B2 | 9/2004 | Henneberry et al. | |
| 6,949,498 | B2 | 9/2005 | Murphy et al. | |
| 7,842,654 | B2 | 11/2010 | Sherry et al. | |
| 8,119,588 | B2 | 2/2012 | Bernhardt et al. | |
| 8,481,747 | B2 | 7/2013 | Schrodi | |
| 8,501,973 | B2 | 8/2013 | Schrodi | |
| 8,569,560 | B2 | 10/2013 | Schrodi | |
| 8,735,640 | B2 | 5/2014 | Cohen et al. | |
| 9,758,751 | B2 * | 9/2017 | Brown | C11D 3/188 |
| 2002/0069901 | A1 | 6/2002 | Evers et al. | |
| 2003/0171241 | A1 | 9/2003 | Henneberry et al. | |
| 2005/0158113 | A1 | 7/2005 | Wehmeyer | |
| 2005/0245424 | A1 | 11/2005 | Tomatsu et al. | |
| 2009/0264672 | A1 | 10/2009 | Abraham et al. | |
| 2009/0281012 | A1 | 11/2009 | Trivedi et al. | |
| 2010/0145086 | A1 | 6/2010 | Schrodi et al. | |
| 2010/0184855 | A1 | 7/2010 | Bernhardt et al. | |
| 2010/0273695 | A1 | 10/2010 | Sehgal et al. | |
| 2011/0113679 | A1 | 5/2011 | Cohen et al. | |
| 2011/0192421 | A1 | 8/2011 | Bigorra et al. | |
| 2012/0295831 | A1 | 11/2012 | Masters et al. | |
| 2013/0037749 | A1 | 2/2013 | Hailu et al. | |
| 2014/0336398 | A1 | 11/2014 | Cohen et al. | |
| 2014/0336399 | A1 | 11/2014 | Cohen et al. | |

FOREIGN PATENT DOCUMENTS

| | | |
|---|---|---|
| WO | 9302169 | 2/1993 |
| WO | 2008048522 | 4/2008 |
| WO | 2009127367 | 10/2009 |
| WO | 2011075642 | 6/2011 |
| WO | 2012061092 | 5/2012 |
| WO | 2012061093 | 5/2012 |
| WO | 2012061094 | 5/2012 |
| WO | 2012061095 | 5/2012 |
| WO | 2012061098 | 5/2012 |
| WO | 2012061101 | 5/2012 |
| WO | 2012061103 | 5/2012 |
| WO | 2012061106 | 5/2012 |
| WO | 2012061108 | 5/2012 |
| WO | 2012061110 | 5/2012 |

OTHER PUBLICATIONS

J.C. Mol., Green Chem. 4 (2002) 5.
J.C. MoL, Topics in Catal. 27 (2004) 97.
Supplementary EP Search Report dated Jan. 13, 2016 issued by the European Patent Office in corresponding EP Application No. 13781047, 8 pages.

* cited by examiner

AQUEOUS HARD SURFACE CLEANERS BASED ON TERPENES AND FATTY ACID DERIVATIVES

This application is a continuation of Ser. No. 14/395,090, filed Oct. 17, 2014, now U.S. Pat. No. 9,758,751.

FIELD OF THE INVENTION

The invention relates to hard surface cleaners, and particularly to aqueous cleaners useful for rapidly removing permanent ink.

BACKGROUND OF THE INVENTION

Hard surface cleaners continuously evolve and adapt to customer demands, changing times, and increasingly strict health and environmental regulations. Successful hard surface cleaners can remove greasy dirt from smooth or highly polished surfaces and disinfect them without leaving behind noticeable films or streaks. Modern aqueous cleaners typically include one or more surfactants in addition to water. Commonly, the cleaners include a small proportion of low-toxicity organic solvent(s), antimicrobial agents, buffers, sequestering agents, builders, bleaching agents, hydrotropes, perfumes or fragrances, and other components.

Permanent marker is the bane of any parent of an inquisitive child. Aqueous hard-surface cleaners designed primarily for home or institutional use are mostly water and are generally ineffective in changing the appearance of markings made with permanent ink. Even solvent-based products are typically less than satisfactory in removing permanent marks from hard surfaces. Black ink is especially difficult to remove. Perhaps more insidious are the (theoretically) preventable markings of graffiti artist-vandals, who often wield permanent markers as their defacing weapons of choice.

Terpene-containing compositions such as lemon oil or pine oil are commonly found in hard surface cleaners. These compositions, which have cleaning and fragrance value, are usually complex mixtures of monoterpenes, particularly hydrocarbons, alcohols (e.g., linalool) and esters (e.g., geranyl acetate). For instance, lemon oil is about 90% monoterpene hydrocarbons, most of which is limonene, with lesser amounts of γ-terpinene, α-pinene, and β-pinene. Pine oil is also complex and species-dependent, often consisting of mostly β-pinene. Many aqueous hard surface cleaners containing lemon oil, pine oil, or other terpene-based fragrances have been described, and many are commercial products. However, the combination of terpene-based oils with fatty dialkyl amides and their use to decolorize permanent marker ink appears to be unknown.

Fatty dialkyl amides have been used in cleaners but typically in industrial applications as solvent-based degreasers for cleaning metal parts during manufacture. In one recent example (see U.S. Pat. Appl. Publ. No. 2011/0192421), the solvent-based degreaser comprises an alkyl dimethyl amide where the alkyl group has from 2 to 56 carbons. Other solvent-based degreasers include terpenes in combination with dibasic esters (see, e.g., U.S. Pat. Appl. Publ. Nos. 2009/0281012 or 2010/0273695).

Fatty dialkyl amides are typically not used in aqueous hard surface cleaners. The same can generally be said for fatty esteramines, which are more often quatemized to give esterquats that are valuable fabric softeners. Similarly, fatty amidoamines are not often used in hard surface cleaners.

More often, they are oxidized to amine oxides or quaternized to other derivatives for use in laundry detergents, shampoos, or agricultural compositions.

Non-aqueous compositions are normally used for graffiti removal. Thus, e.g., U.S. Pat. No. 6,797,684 teaches to use an 80:20 mixture of d-limonene and a lactate ester to remove graffiti better than straight d-limonene. Other graffiti removers include N-methyl-2-pyrrolidone (NMP) as the principal component. See, e.g., U.S. Pat. No. 5,712,234 (NMP, a dye non-solvent, and a dye bleaching agent for permanent marker removal) and U.S. Pat. No. 5,773,091 (NMP-based graffiti remover designed for use in treating wax-coated surfaces).

Occasionally, hard surface cleaners have been formulated to contain fatty esters or amides made by hydrolysis or transesterification of triglycerides, which are typically animal or vegetable fats. Consequently, the fatty portion of the acid or ester will typically have 6-22 carbons with a mixture of saturated and internally unsaturated chains. Depending on source, the fatty acid or ester often has a preponderance of $C_{16}$ to $C_{22}$ component. For instance, methanolysis of soybean oil provides the saturated methyl esters of palmitic ($C_{16}$) and stearic ($C_{18}$) acids and the unsaturated methyl esters of oleic ($C_{18}$ mono-unsaturated), linoleic ($C_{18}$ di-unsaturated), and α-linolenic ($C_{18}$ tri-unsaturated) acids. These materials are generally less than completely satisfactory, however, because compounds having such large carbon chains can behave functionally as soil under some cleaning conditions.

Improvements in metathesis catalysts (see J. C. Mol, *Green Chem.* 4 (2002) 5) provide an opportunity to generate reduced chain length, monounsaturated feedstocks, which are valuable for making detergents and surfactants, from $C_{16}$ to $C_{22}$-rich natural oils such as soybean oil or palm oil. Soybean oil and palm oil can be more economical than, for example, coconut oil, which is a traditional starting material for making detergents. Cross-metathesis of unsaturated fatty esters with olefins generates new olefins and new unsaturated esters that can have reduced chain length and that may be difficult to make otherwise. Despite the availability of unsaturated fatty esters having reduced chain length and/or predominantly trans-configuration of the unsaturation, surfactants have generally not been made from these feedstocks.

Recently, we described new compositions made from feedstocks based on self-metathesis of natural oils or cross-metathesis of natural oils and olefins. Among other compositions, we identified certain esteramines, fatty amides, and fatty amidoamines made by derivatizing the unique feedstocks (see Internat. Appl. Nos. PCT/US 11/57596, 11/57597, and 11/57602, respectively), all filed Oct. 25, 2011). We also investigated the use of many varieties of derivatives made from metathesis-based feedstocks in aqueous and non-aqueous hard surface cleaners (see Internat. Appl. No. PCT/US 11/57612, filed Oct. 25, 2011). In the '612 application, we observed that the fatty dialkyl amides are excellent as non-aqueous degreasers, while the fatty amidoamines and esteramines are generally inferior in that application. None of these proved to be a superior performer in the aqueous systems studied. No terpenes were present in the test formulations, and no tests were performed on permanent marker ink.

In sum, improved hard surface cleaners are always in demand. An aqueous all-purpose cleaner with the ability to decolorize permanent marker—until now just a dream—would be valuable. Ideally, the cleaner could rapidly extinguish even black permanent marks from hard, non-porous surfaces while avoiding the need for high concentrations of aggressive organic solvents. A valuable composition could be supplied as a concentrate and would complement commercially available aqueous hard surface cleaners to avoid the need to reformulate.

SUMMARY OF THE INVENTION

In one aspect, the invention relates to aqueous hard surface cleaner compositions. The compositions comprise 75 to 99 wt. % of water; 0.1 to 5 wt. % of a monoterpene; 0.1 to 5 wt. % of a $C_{10}$-$C_{17}$ fatty acid derivative; and 0.1 to 5 wt. % of one or more surfactants selected from anionic, cationic, nonionic, and amphoteric surfactants. The fatty acid derivative is selected from N,N-dialkyl amides, N,N-dialkyl esteramines, and N,N-dialkyl amidoamines. Preferably, a base such as sodium carbonate or monoethanolamine is also included. In another aspect, the invention relates to dilutable hard surface cleaner concentrates. The concentrates comprise 1 to 50 wt. % of a monoterpene; 1 to 50 wt. % of a $C_{10}$-$C_{16}$ fatty acid derivative selected from N,N-dialkyl amides, N,N-dialkyl esteramines, and N,N-dialkyl amidoamines; and 1 to 50 wt. % of one or more surfactants.

We surprisingly found that the combination of a monoterpene and certain fatty acid derivatives, especially fatty N,N-dialkyl amides, can enable even dilute aqueous compositions to rapidly decolorize and remove permanent marker from hard, non-porous surfaces. The inventive compositions dramatically extend the reach of commercial all-purpose cleaners.

In other aspects, the invention relates to methods for removing permanent ink markings from hard surfaces, graffiti remover compositions, permanent marker/eraser combinations, correction pens, and correction fluids based on the inventive hard surface cleaner compositions.

DETAILED DESCRIPTION OF THE INVENTION

Aqueous hard surface cleaners of the invention are commonly used as all-purpose cleaners intended for use in cleaning kitchens, bathrooms, appliances, and generally any suitably hard, non-porous surface, such as metal, plastic, granite, laminate, linoleum, tile, glass, synthetic rubber, or the like. The compositions comprise 75 to 99 wt. %, preferably 85 to 99 wt. %, more preferably 90 to 99 wt. %, and most preferably 95 to 99 wt. % water. The mineral content of the water is not critical; it can be deionized, distilled, tap water, treated water, spring water, or the like. Generally, a higher proportion of water gives a more economical composition.

Monoterpenes

The aqueous hard surface cleaners comprise 0.1 to 5 wt. %, preferably 0.1 to 2 wt. %, more preferably from 0.2 to 1 wt. %, most preferably 0.4 to 1 wt. % of a monoterpene. By "monoterpene," we mean one or more compounds derived from two isoprene units that may be cyclic or acyclic and are either hydrocarbons or have hydroxyl, ester, aldehyde, or ketone functionality. Although a single monoterpene compound can be used, suitable monoterpenes are more commonly complex mixtures of terpene or terpenoid compounds that occur in nature or are produced synthetically. Examples of such naturally occurring mixtures are lemon oil, pine oil, lavender oil, and the like. The monoterpenes can include, for example, limonene, α-pinene, β-pinene, carene, α-terpinene, γ-terpinene, α-terpineol, camphene, p-cymene, myrcene, sabinene, and the like, and mixtures thereof. Lemon oil, for instance, contains about 90% monoterpene hydrocarbons, mostly limonene, with lesser amounts of γ-terpinene, α-pinene, and β-pinene. Limonene, lemon oil, β-pinene, and pine oil are particularly preferred monoterpenes. Higher terpenes (i.e., sesquiterpenes, diterpenes, etc.) can be present with the monoterpenes. For additional examples of suitable monoterpenes, see U.S. Pat. Nos. 4,790,951; 5,614,484; 5,614,484; and U.S. Pat. Appl. Publ. Nos. 2002/0069901 and 2005/0245424, the teachings of which are incorporated herein by reference.

General Note Regarding Chemical Structures:

As the skilled person will recognize, products made in accordance with the invention are typically mixtures of cis- and trans-isomers. Except as otherwise indicated, all of the structural representations provided herein show only a trans-isomer. The skilled person will understand that this convention is used for convenience only, and that a mixture of cis- and trans-isomers is understood unless the context dictates otherwise. Structures shown often refer to a principal product that may be accompanied by a lesser proportion of other components or positional isomers. Thus, the structures provided represent likely or predominant products. Charges may or may not be shown but are understood, as in the case of amine oxide structures.

Fatty Acid Derivatives

The aqueous hard surface cleaners comprise 0.1 to 5 wt. %, preferably 0.1 to 2 wt. %, more preferably from 0.2 to 1 wt. %, most preferably 0.4 to 1 wt. %, of a $C_{10}$-$C_{17}$ fatty acid derivative. The fatty acid derivative is selected from N,N-dialkyl amides, N,N-dialkyl esteramines, and N,N-dialkyl amidoamines.

Preferred N,N-dialkyl amides, N,N-dialkyl esteramines, and N,N-dialkyl amidoamines have the general structure:

$$R^1\text{—CO—}X_m\text{-}A_n\text{-}NR^2R^3$$

where $R^1$ is a $C_9$-$C_{16}$ chain that is linear or branched, saturated or unsaturated; X is O or NH; A is $C_2$-$C_8$ alkylene; m is 0 or 1; n is 0 or 1; and $R^2$ and $R^3$ are the same or different $C_1$-$C_6$ alkyl. When m=1, n=1, and when m=0, n=0. For the N,N-dialkyl amides, m=n=0. For the N,N-dialkyl esteramines, m=n=1 and X=O. For the N,N-dialkyl amidoamines, m=n=1 and X=NH.

N,N-Dialkyl Amides

Preferred N,N-dialkyl amides have a $C_{10}$-$C_{17}$ chain that is linear or branched, preferably linear. The alkyl groups attached to nitrogen are preferably the same, preferably $C_1$-$C_3$ alkyl, and more preferably both methyl or ethyl. Suitable N,N-dialkyl amides are commercially available, and may contain mixtures of N,N-dialkyl amides.

For instance, one suitable N,N-dialkyl amide is Steposol® M-8-10, a mixture of N,N-dimethyl caprylamide and N,N-dimethyl capramide, which is available from Stepan Company. Suitable N,N-dialkyl amides can be made by reacting a secondary amine such as dimethylamine or diethylamine with a $C_{10}$-$C_{17}$ fatty acid or ester.

Some N,N-dialkyl amides are monounsaturated and have the formula:

$$R^1\text{CO—}NR^2R^3$$

where $R^1$ is $R^4$—$C_9H_{16}$—; $R^4$ is hydrogen or $C_1$-$C_7$ alkyl; and each of $R^2$ and $R^3$ is independently $C_1$-$C_6$ alkyl. Preferably, $R^1$ is $R^4CH{=}CH{-}(CH_2)_7$—.

Some specific examples of suitable $C_{10}$, $C_{12}$, $C_{14}$, and $C_{16}$-based fatty amides appear below:

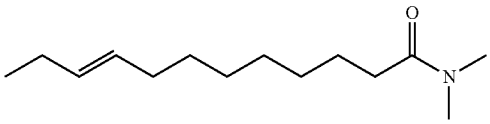

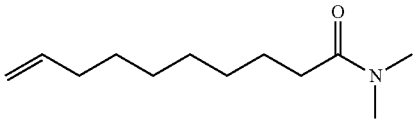

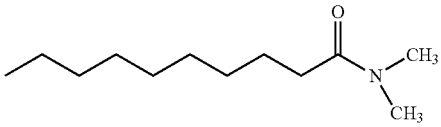

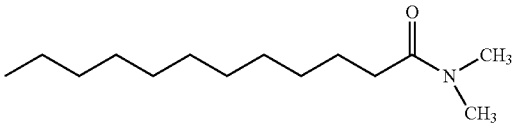

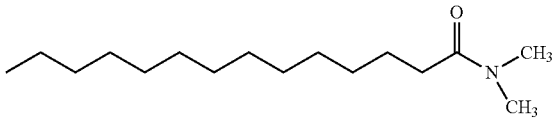

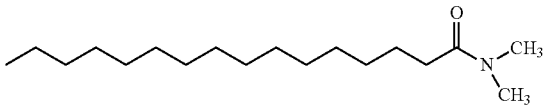

-continued

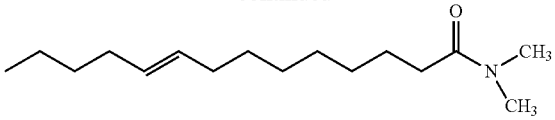

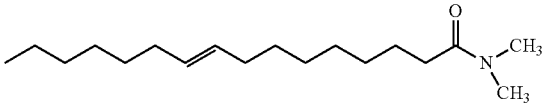

N,N-Dialkyl Esteramines

Preferred N,N-dialkyl esteramines have a $C_{10}$-$C_{17}$ chain that is linear or branched, preferably linear. The alkyl groups attached to nitrogen are preferably the same, preferably $C_1$-$C_3$ alkyl, and more preferably both are methyl or ethyl. Suitable N,N-dialkyl esteramines are typically made by reacting an N,N-dialkyl alkanolamine, such as N,N-dimethylethanolamine, N,N-diethylethanolamine, N,N-dimethylpropanol-amine, or N,N-dimethylisopropanolamine with a $C_{10}$-$C_{17}$ fatty acid or ester.

Some N,N-dialkyl esteramines are monounsaturated and have the formula:

$$R^1(R^2)—N—(CH_2)_n—(CHCH_3)_z—O—CO—R^3$$

wherein:

each of $R^1$ and $R^2$ is independently $C_1$-$C_6$ alkyl; $R^3$ is $—C_9H_{16}—R^4$; $R^4$ is hydrogen or $C_1$-$C_7$ alkyl; n=1-4; z=0 or 1; and when z=0, n=2-4. Preferably, $R^3$ is $—(CH_2)_7—CH=CHR^4$.

Some specific examples of $C_{10}$, $C_{12}$, $C_{14}$, and $C_{16}$-based esteramines appear below:

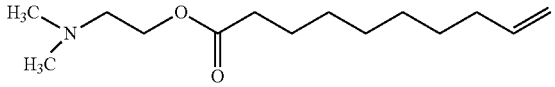

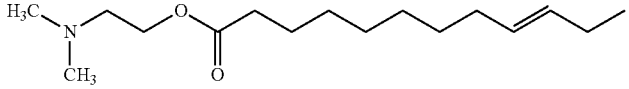

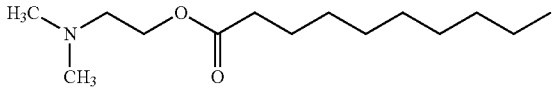

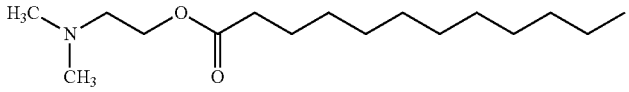

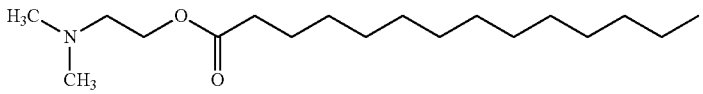

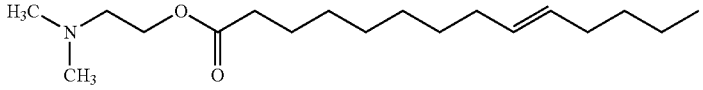

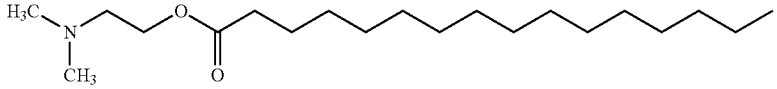

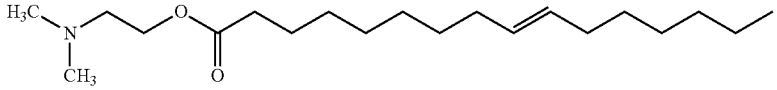

N,N-Dialkyl Amidoamines

Preferred N,N-dialkyl amidoamines have a $C_{10}$-$C_{17}$ chain that is linear or branched, preferably linear. The alkyl groups attached to nitrogen are preferably the same, preferably $C_1$-$C_3$ alkyl, and more preferably both methyl or ethyl. Suitable N,N-dialkyl amidoamines are typically made by reacting an aminoalkyl-substituted tertiary amine such as N,N-dimethyl-1,2-ethanediamine, N,N-dimethyl-1,3-propanediamine (DMAPA), N,N-diethyl-1,3-propanediamine, or N,N-dimethyl-1,4-butanediamine with a $C_{10}$-$C_{17}$ fatty acid or ester.

Some N,N-dialkyl amidoamines are monounsaturated and have the formula:

$$R^3(R^2)N(CH_2)_nNH(CO)R^1$$

where:

$R^1$ is —$C_9H_{16}$—$R^4$; each of $R^2$ and $R^3$ is independently $C_1$-$C_6$ alkyl; $R^4$ is hydrogen or $C_1$-$C_7$ alkyl; and n=2-8. Preferably, $R^1$ is —$(CH_2)_7$—CH═CH$R^4$.

Specific examples of suitable $C_{10}$, $C_{12}$, $C_{14}$ and $C_{16}$-based N,N-dialkyl amidoamines appear below:

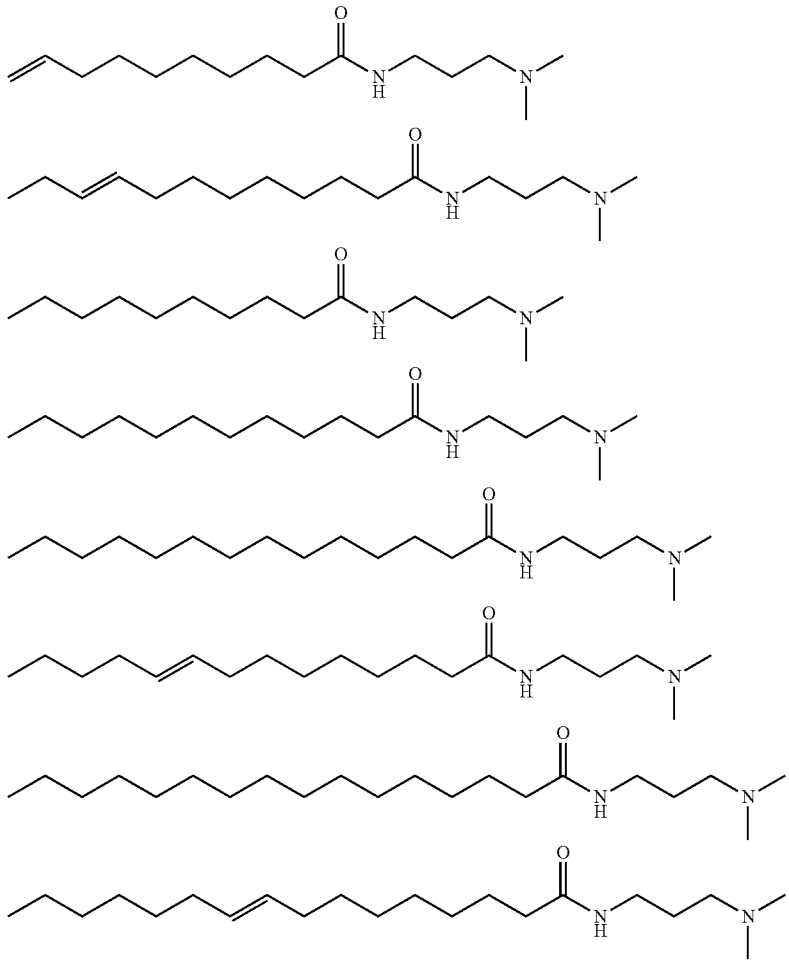

Metathesis-Derived Fatty Acid Derivatives

In a preferred aspect, the fatty acid derivative is metathesis-derived. The derivatives are typically made from a $C_{10}$-$C_{17}$ fatty acid or fatty ester feedstock, where the feedstock is generated by cross-metathesis of longer-chain fatty acids or fatty esters with a lower olefin, typically ethylene, propylene, 1-butene or the like. More details regarding the preparation of suitable metathesis-based feedstocks and derivatives appear below.

In one aspect, the $C_{10}$-$C_{17}$ fatty acid or fatty ester feedstock is monounsaturated and is derived from metathesis of a natural oil. Traditionally, these materials, particularly the short-chain acids and derivatives (e.g., 9-decylenic acid or 9-dodecylenic acid) have been difficult to obtain except in lab-scale quantities at considerable expense. However, because of the recent improvements in metathesis catalysts, these acids and their ester derivatives are now available in bulk at reasonable cost. Thus, the $C_{10}$-$C_{17}$ monounsaturated acids and esters are conveniently generated by cross-metathesis of natural oils with olefins, preferably α-olefins, and particularly ethylene, propylene, 1-butene, 1-hexene, 1-octene, and the like. Preferably, at least a portion of the $C_{10}$-$C_{17}$ monounsaturated acid has "$\Delta^9$" unsaturation, i.e., the carbon-carbon double bond in the $C_{10}$-$C_{16}$ acid is at the 9-position with respect to the acid carbonyl. In other words, there are preferably seven carbons between the acid carbonyl group and the olefin group at $C_9$ and $C_{10}$. For the $C_{11}$ to $C_{17}$ acids, an alkyl chain of 1 to 7 carbons, respectively is attached to $C_{10}$. Preferably, the unsaturation is at least 1 mole % trans-$\Delta^9$, more preferably at least 25 mole % trans-$\Delta^9$, more preferably at least 50 mole % trans-$\Delta^9$, and even more preferably at least 80% trans-$\Delta^9$. The unsaturation may be greater than 90 mole %, greater than 95 mole %, or even 100% trans-$\Delta^9$. In contrast, naturally sourced fatty acids that have $\Delta^9$ unsaturation, e.g., oleic acid, usually have ~100% cis-isomers.

Although a high proportion of trans-geometry (particularly trans-$\Delta^9$ geometry) may be desirable in the metathesis-derived fatty amines and derivatives of the invention, the skilled person will recognize that the configuration and the exact location of the carbon-carbon double bond will depend on reaction conditions, catalyst selection, and other factors. Metathesis reactions are commonly accompanied by isomerization, which may or may not be desirable. See, for example, G. Djigoué and M. Meier, *Appl. Catal. A: General* 346 (2009) 158, especially FIG. 3. Thus, the skilled person might modify the reaction conditions to control the degree of isomerization or alter the proportion of cis- and trans-isomers generated. For instance, heating a metathesis product in the presence of an inactivated metathesis catalyst might allow the skilled person to induce double bond migration to give a lower proportion of product having trans-$\Delta^9$ geometry.

Suitable metathesis-derived $C_{10}$-$C_{17}$ monounsaturated acids include, for example, 9-decylenic acid (9-decenoic acid), 9-undecenoic acid, 9-dodecylenic acid (9-dodecenoic acid), 9-tridecenoic acid, 9-tetradecenoic acid, 9-pentadecenoic acid, 9-hexadecenoic acid, 9-heptadecenoic acid, and the like, and their ester derivatives.

Usually, cross-metathesis of the natural oil is followed by separation of an olefin stream from a modified oil stream, typically by distilling out the more volatile olefins. The modified oil stream is then reacted with a lower alcohol, typically methanol, to give glycerin and a mixture of alkyl esters. This mixture normally includes saturated $C_6$-$C_{22}$ alkyl esters, predominantly $C_{16}$-$C_{18}$ alkyl esters, which are essentially spectators in the metathesis reaction. When the natural oil is cross-metathesized with an $\alpha$-olefin and the product mixture is transesterified, the resulting alkyl ester mixture includes a $C_{10}$ unsaturated alkyl ester and one or more $C_{11}$ to $C_{17}$ unsaturated alkyl ester coproducts in addition to the glycerin by-product. The terminally unsaturated $C_{10}$ product is accompanied by different coproducts depending upon which $\alpha$-olefin(s) is used as the cross-metathesis reactant. Thus, 1-butene gives a $C_{12}$ unsaturated alkyl ester, 1-hexene gives a $C_{14}$ unsaturated alkyl ester, and so on. As is demonstrated in the examples below, the $C_{10}$ unsaturated alkyl ester is readily separated from the $C_{11}$ to $C_{17}$ unsaturated alkyl ester and each is easily purified by fractional distillation. These fatty acids and alkyl esters are excellent starting materials for making the N,N-dialkyl amides, N,N-dialkyl esteramines, and N,N-dialkyl amidoamines for the inventive hard surface cleaners.

Natural oils suitable for use as a feedstock to generate the $C_{10}$-$C_{17}$ monounsaturated acids or esters from cross-metathesis with olefins are well known. Suitable natural oils include vegetable oils, algal oils, animal fats, tall oils, derivatives of the oils, and combinations thereof. Thus, suitable natural oils include, for example, soybean oil, palm oil, rapeseed oil, coconut oil, palm kernel oil, sunflower oil, safflower oil, sesame oil, corn oil, olive oil, peanut oil, cottonseed oil, canola oil, castor oil, tallow, lard, poultry fat, fish oil, and the like. Soybean oil, palm oil, rapeseed oil, and mixtures thereof are preferred natural oils.

Genetically modified oils, e.g., high-oleate soybean oil or genetically modified algal oil, can also be used. Preferred natural oils have substantial unsaturation, as this provides a reaction site for the metathesis process for generating olefins. Particularly preferred are natural oils that have a high content of unsaturated fatty groups derived from oleic acid. Thus, particularly preferred natural oils include soybean oil, palm oil, algal oil, and rapeseed oil.

A modified natural oil, such as a partially hydrogenated vegetable oil, can be used instead of or in combination with the natural oil. When a natural oil is partially hydrogenated, the site of unsaturation can migrate to a variety of positions on the hydrocarbon backbone of the fatty ester moiety. Because of this tendency, when the modified natural oil is cross-metathesized with the olefin, the reaction products will have a different and generally broader distribution compared with the product mixture generated from an unmodified natural oil. However, the products generated from the modified natural oil are similarly converted to the N,N-dialkyl amides, N,N-dialkyl esteramines, and N,N-dialkyl amidoamines.

An alternative to using a natural oil as a feedstock to generate the $C_{10}$-$C_{17}$ monounsaturated acid or ester from cross-metathesis with olefins is a monounsaturated fatty acid obtained by the hydrolysis of a vegetable oil or animal fat, or an ester or salt of such an acid obtained by esterification of a fatty acid or carboxylate salt, or by transesterification of a natural oil with an alcohol. Also useful as starting compositions are polyunsaturated fatty esters, acids, and carboxylate salts. The salts can include an alkali metal (e.g., Li, Na, or K); an alkaline earth metal (e.g., Mg or Ca); a Group 13-15 metal (e.g., B, Al, Sn, Pb, or Sb), or a transition, lanthanide, or actinide metal. Additional suitable starting compositions are described at pp. 7-17 of PCT application WO 2008/048522, the contents of which are incorporated by reference herein.

The other reactant in the cross-metathesis reaction is an olefin. Suitable olefins are internal or $\alpha$-olefins having one or more carbon-carbon double bonds. Mixtures of olefins can be used. Preferably, the olefin is a monounsaturated $C_2$-$C_{10}$ $\alpha$-olefin, more preferably a monounsaturated $C_2$-$C_8$ $\alpha$-olefin. Preferred olefins also include $C_4$-$C_9$ internal olefins. Thus, suitable olefins for use include, for example, ethylene, propylene, 1-butene, cis- and trans-2-butene, 1-pentene, isohexylene, 1-hexene, 3-hexene, 1-heptene, 1-octene, 1-nonene, 1-decene, and the like, and mixtures thereof.

Cross-metathesis is accomplished by reacting the natural oil and the olefin in the presence of a homogeneous or heterogeneous metathesis catalyst. Suitable homogeneous metathesis catalysts include combinations of a transition metal halide or oxo-halide (e.g., $WOCl_4$ or $WCl_6$) with an alkylating cocatalyst (e.g., $Me_4Sn$). Preferred homogeneous catalysts are well-defined alkylidene (or carbene) complexes of transition metals, particularly Ru, Mo, or W. These include first and second-generation Grubbs catalysts, Grubbs-Hoveyda catalysts, and the like. Suitable alkylidene catalysts have the general structure:

$$M[X^1X^2L^1L^2(L^3)_n]=C_m=C(R^1)R^2$$

where M is a Group 8 transition metal, $L^1$, $L^2$, and $L^3$ are neutral electron donor ligands, n is 0 (such that $L^3$ may not be present) or 1, m is 0, 1, or 2, $X^1$ and $X^2$ are anionic ligands, and $R^1$ and $R^2$ are independently selected from H, hydrocarbyl, substituted hydrocarbyl, heteroatom-containing hydrocarbyl, substituted heteroatom-containing hydrocarbyl, and functional groups. Any two or more of $X^1$, $X^2$, $L^1$, $L^2$, $L^3$, $R^1$ and $R^2$ can form a cyclic group and any one of those groups can be attached to a support.

First-generation Grubbs catalysts fall into this category where m=n=0 and particular selections are made for n, $X^1$, $X^2$, $L^1$, $L^2$, $L^3$, $R^1$ and $R^2$ as described in U.S. Pat. Appl.

Publ. No. 2010/0145086 ("the '086 publication"), the teachings of which related to all metathesis catalysts are incorporated herein by reference.

Second-generation Grubbs catalysts also have the general formula described above, but $L^1$ is a carbene ligand where the carbene carbon is flanked by N, O, S, or P atoms, preferably by two N atoms. Usually, the carbene ligand is party of a cyclic group. Examples of suitable second-generation Grubbs catalysts also appear in the '086 publication.

In another class of suitable alkylidene catalysts, $L^1$ is a strongly coordinating neutral electron donor as in first- and second-generation Grubbs catalysts, and $L^2$ and $L^3$ are weakly coordinating neutral electron donor ligands in the form of optionally substituted heterocyclic groups. Thus, $L^2$ and $L^3$ are pyridine, pyrimidine, pyrrole, quinoline, thiophene, or the like.

In yet another class of suitable alkylidene catalysts, a pair of substituents is used to form a bi- or tridentate ligand, such as a biphosphine, dialkoxide, or alkyldiketonate. Grubbs-Hoveyda catalysts are a subset of this type of catalyst in which $L^2$ and $R^2$ are linked. Typically, a neutral oxygen or nitrogen coordinates to the metal while also being bonded to a carbon that is α-, β-, or γ- with respect to the carbene carbon to provide the bidentate ligand. Examples of suitable Grubbs-Hoveyda catalysts appear in the '086 publication.

The structures below provide just a few illustrations of suitable catalysts that may be used:

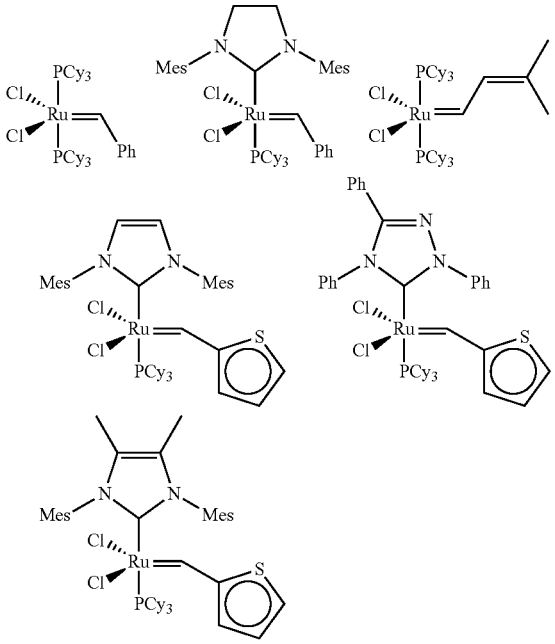

Heterogeneous catalysts suitable for use in the cross-metathesis reaction include certain rhenium and molybdenum compounds as described, e.g., by J. C. Mol in *Green Chem.* 4 (2002) 5 at pp. 11-12. Particular examples are catalyst systems that include $Re_2O_7$ on alumina promoted by an alkylating cocatalyst such as a tetraalkyl tin lead, germanium, or silicon compound. Others include $MoCl_3$ or $MoCl_5$ on silica activated by tetraalkyltins.

For additional examples of suitable catalysts for cross-metathesis, see U.S. Pat. No. 4,545,941, the teachings of which are incorporated herein by reference, and references cited therein.

In one aspect, the ester is a lower alkyl ester, especially a methyl ester. The lower alkyl esters are preferably generated by transesterifying a metathesis-derived triglyceride. For example, cross-metathesis of a natural oil with an olefin, followed by removal of unsaturated hydrocarbon metathesis products by stripping, and then transesterification of the modified oil component with a lower alkanol under basic conditions provides a mixture of unsaturated lower alkyl esters. The unsaturated lower alkyl ester mixture can be used "as is" to make the N,N-dialkyl amides, N,N-dialkyl esteramines, and N,N-dialkyl amidoamines or it can be purified to isolate particular alkyl esters prior to making the fatty acid derivatives.

Bases

The hard surface cleaners preferably include a base. Suitable bases include alkali metal and alkaline earth metal hydroxides, carbonates, bicarbonates, silicates, metasilicates. Alkanolamines, such as ethanolamine or isopropanolamine can also be used to adjust the alkalinity of the formulation. When present, the base is typically used in an amount within the range of 0.1 to 5 wt. %, preferably 0.1 to 2 wt. %, and more preferably 0.2 to 1 wt. %. Alkali metal carbonates such as sodium carbonate are particularly preferred.

Surfactants

The aqueous hard surface cleaners comprise one or more surfactants selected from anionic, cationic, nonionic and amphoteric (or zwitterionic) surfactants. The amount of surfactant in the cleaner is 0.1 to 5 wt. %, preferably 0.1 to 4 wt. %, and most preferably 0.2 to 3 wt. %. Combinations of different surfactants can be used. Commonly, an anionic surfactant is paired with a nonionic or amphoteric surfactant. Suitable surfactants are generally known in the art. If desired, one or more of the surfactants can be derived from a metathesis-based feedstock.

Anionic Surfactants

Suitable anionic surfactants are well known in the art. They include, for example, alkyl sulfates, alkyl ether sulfates, olefin sulfonates, α-sulfonated alkyl esters (particularly α-sulfonated methyl esters), α-sulfonated alkyl carboxylates, alkyl aryl sulfonates, sulfoacetates, sulfosuccinates, alkane sulfonates, and alkylphenol alkoxylate sulfates, and the like, and mixtures thereof.

In particular, anionic surfactants useful herein include those disclosed in *McCutcheon's Detergents & Emulsifiers* (M.C. Publishing, N. American Ed., 1993); Schwartz et al., *Surface Active Agents. Their Chemistry and Technology* (New York: Interscience, 1949); and in U.S. Pat. Nos. 4,285,841 and 3,919,678, the teachings of which are incorporated herein by reference.

Suitable anionic surfactants include salts (e.g., sodium, potassium, ammonium, and substituted ammonium salts such as mono-, di-, and triethanolamine salts) of anionic sulfate, sulfonate, carboxylate and sarcosinate surfactants. Other suitable anionic surfactants include isethionates (e.g., acyl isethionates), N-acyl taurates, fatty amides of methyl tauride, alkyl succinates, glutamates, sulfoacetates, and sulfosuccinates, monoesters of sulfosuccinate (especially saturated and unsaturated $C_{12}$-$C_{18}$ monoesters), diesters of sulfosuccinate (especially saturated and unsaturated $C_6$-$C_{14}$ diesters), and N-acyl sarcosinates. Resin acids and hydrogenated resin acids are also suitable, such as rosin, hydrogenated rosin, and resin acids and hydrogenated resin acids present in or derived from tallow oil.

Suitable anionic surfactants include linear and branched primary and secondary alkyl sulfates, alkyl ethoxysulfates, fatty oleyl glycerol sulfates, alkyl phenol ethoxylate sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside. Preferred alkyl sulfates include $C_8$-$C_{22}$, more preferably $C_8$-$C_{16}$, alkyl sulfates. Preferred alkyl ethoxysulfates are $C_8$-$C_{22}$, more preferably $C_8$-$C_{16}$, alkyl sulfates that have been ethoxylated with from 0.5 to 30, more preferably from 1 to 30, moles of ethylene oxide per molecule.

Other suitable anionic surfactants include salts of $C_5$-$C_{20}$ linear alkylbenzene sulfonates, alkyl ester sulfonates, $C_6$-$C_{22}$ primary or secondary alkane sulfonates, $C_6$-$C_{24}$ olefin sulfonates, alkyl glycerol sulfonates, fatty acyl glycerol sulfonates, fatty oleyl glycerol sulfonates, and any mixtures thereof.

Suitable anionic surfactants include $C_8$-$C_{22}$, preferably $C_8$-$C_{18}$, alkyl sulfonates and $C_8$-$C_{22}$, preferably $C_{12}$-$C_{18}$, α-olefin sulfonates. Suitable anionic carboxylate surfactants include alkyl ethoxy carboxylates, alkyl polyethoxy polycarboxylate surfactants and soaps ("alkyl carboxyls"). Preferred sulfosuccinates are $C_8$-$C_{22}$ sulfosuccinates, preferably mono-$C_{10}$-$C_{16}$ alkyl sulfosuccinates such as disodium laureth sulfosuccinate.

Suitable anionic surfactants include sarcosinates of the formula $RCON(R_1)CH_2COOM$, wherein R is a $C_5$-$C_{22}$ linear or branched alkyl or alkenyl group, $R_1$ is $C_1$-$C_4$ alkyl and M is an ion. Preferred sarcosinates include myristyl and oleoyl methyl sarcosinates as sodium salts. Most preferably, the sarcosinate is a $C_{10}$-$C_{16}$ sarcosinate.

Suitable anionic surfactants include alkyl sulfoacetates of the formula $RO(CO)CH_2SO_3M$, wherein R is $C_{12}$-$C_{20}$ alkyl and M is an ion, preferably lauryl and myristyl sulfoacetates as sodium salts.

Many suitable anionic surfactants are commercially available from Stepan Company and are sold under the Alpha-Step®, Bio-Soft®, Bio-Terge®, Cedepal®, Nacconol®, Ninate®, Polystep®, Steol®, Stepanate®, Stepanol®, Stepantan®, and Steposol® trademarks. For further examples of suitable anionic surfactants, see U.S. Pat. No. 6,528,070, the teachings of which are incorporated herein by reference.

Additional examples of suitable anionic surfactants are described in U.S. Pat. Nos. 3,929,678, 5,929,022, 6,399,553, 6,489,285, 6,511,953, 6,949,498, and U.S. Pat. Appl. Publ. No. 2010/0184855, the teachings of which are incorporated herein by reference.

Cationic Surfactants

Suitable cationic surfactants include fatty amine salts (including diamine or polyamine salts), quaternary ammonium salts, salts of fatty amine ethoxylates, quaternized fatty amine ethoxylates, and the like, and mixtures thereof. Useful cationic surfactants are disclosed in *McCutcheon's Detergents & Emulsifiers* (M.C. Publishing, N. American Ed., 1993); Schwartz et al., *Surface Active Agents. Their Chemistry and Technology* (New York: Interscience, 1949) and in U.S. Pat. Nos. 3,155,591; 3,929,678; 3,959,461; 4,275,055; and 4,387,090. Suitable anions include halogen, sulfate, methosulfate, ethosulfate, tosylate, acetate, phosphate, nitrate, sulfonate, carboxylate, and the like.

Suitable quaternary ammonium salts include mono-long chain alkyl-tri-short chain alkyl ammonium halides, wherein the long chain alkyl group has from about 8 to about 22 carbon atoms and is derived from long-chain fatty acids, and wherein the short chain alkyl groups can be the same or different but preferably are independently methyl or ethyl. Specific examples include cetyl trimethyl ammonium chloride and lauryl trimethyl ammonium chloride. Preferred cationic surfactants include octyltrimethyl ammonium chloride, decyltrimethyl ammonium chloride, dodecyltrimethyl ammonium bromide, dodecyitrimethyl ammonium chloride, and the like. Cetrimonium chloride (hexadecyitrimethylammonium chloride) supplied as Ammonyx® Cetac 30, product of Stepan Company) is a preferred example.

Salts of primary, secondary and tertiary fatty amines are also suitable cationic surfactants. The alkyl groups of such amine salts preferably have from about 12 to about 22 carbon atoms, and may be substituted or unsubstituted. Secondary and tertiary amine salts are preferred, and tertiary amine salts are particularly preferred. Suitable amine salts include the halogen, acetate, phosphate, nitrate, citrate, lactate and alkyl sulfate salts. Salts of, for example, stearamidopropyl dimethyl amine, diethylaminoethyl stearamide, dimethyl stearamine, dimethyl soyamine, soyamine, myristyl amine, tridecylamine, ethyl stearylamine, N-tallowpropane diamine, ethoxylated stearylamine, stearylamine hydrogen chloride, soyamine chloride, stearylamine formate, N-tallowpropane diamine dichloride stearamidopropyl dimethylamine citrate, and the like are useful herein.

Suitable cationic surfactants include imidazolines, imidazoliniums, and pyridiniums, and the like, such as, for example, 2-heptadecyl-4,5-dihydro-1H-imidazol-1-ethanol, 4,5-dihydro-1-(2-hydroxyethyl)-2-isoheptadecyl-1 phenylmethylimidazolium chloride, and 1-[2-oxo-2-[[2-[(1-oxoctadecyl)oxy]ethyl]-amino]ethyl] pyridinium chloride. For more examples, see U.S. Pat. No. 6,528,070, the teachings of which are incorporated herein by reference. Other suitable cationic surfactants include quaternized esteramines or "ester quats," and as disclosed in U.S. Pat. No. 5,939,059, the teachings of which are incorporated herein by reference. The cationic surfactant may be a DMAPA or other amidoamine-based quaternary ammonium material, including diamidoamine quats. It may also be a di- or poly-quaternary compound (e.g., a diester quat or a diamidoamine quat). Anti-microbial compounds, such as alkyldimethylbenzyl ammonium halides or their mixtures with other quaternary compounds, are also suitable cationic surfactants. An example is a mixture of an alkyl dimethylbenzyl ammonium chloride and an alkyl dimethyl ethylbenzylammonium chloride, available commercially from Stepan Company as BTC® 2125M.

Many suitable cationic surfactants are commercially available from Stepan Company and are sold under the Ammonyx®, Accosoft®, Amphosol®, BTC®, Stepanquat®, and Stepantex® trademarks. For further examples of suitable cationic surfactants, see U.S. Pat. No. 6,528,070, the teachings of which are incorporated herein by reference.

Nonionic or Amphoteric Surfactants

Nonionic surfactants typically function as wetting agents, hydrotropes, and/or couplers. Nonionic surfactants have no charged moieties. Suitable nonionic surfactants include, for example, fatty alcohols, alcohol fatty esters, fatty alcohol ethoxylates, alkylphenol ethoxylates, alkoxylate block copolymers, alkoxylated fatty amides, fatty amides, castor oil alkoxylates, polyol esters, fatty methyl esters, glycerol esters, glycol fatty esters, tallow amine ethoxylates, polyethylene glycol esters, and the like. Fatty alcohol ethoxylates are preferred.

Amphoteric (or zwitterionic) surfactants have both cationic and anionic groups in the same molecule, typically over a wide pH range. Suitable amphoteric surfactants include, for example, amine oxides, betaines, sulfobetaines, and the like. Specific examples include cocoamidopropylamine oxide, cetamine oxide, lauramine oxide, myristylamine oxide, stearamine oxide, alkyl betaines, cocobetaines, and amidopropyl betaines, (e.g., lauryl betaines, cocoamidopropyl betaines, lauramidopropyl betaines), and combinations thereof.

Other suitable nonionic and amphoteric surfactants are disclosed in U.S. Pat. Nos. 5,814,590, 6,281,178, 6,284,723, 6,605,584, and 6,511,953, the teachings of which related to those surfactants are incorporated herein by reference.

Organic Solvents

An organic solvent, preferably a water-soluble one, is optionally included in the hard surface cleaners. Preferred solvents include alcohols, glycols, glycol ethers, glycol ether esters, amides, esters, and the like. Examples include $C_1$-$C_6$ alcohols, $C_1$-$C_6$ diols, $C_3$-$C_{24}$ glycol ethers, and mixtures thereof. Suitable alcohols include, for example, methanol, ethanol, 1-propanol, isopropanol, 1-butanol, 1-pentanol, 1-hexanol, amyl alcohol, and mixtures thereof. Suitable glycol ethers include, e.g., ethylene glycol n-butyl ether, ethylene glycol n-propyl ether, propylene glycol methyl ether, propylene glycol n-propyl ether, propylene glycol tert-butyl ether, propylene glycol n-butyl ether, diethylene glycol n-butyl ether, dipropylene glycol methyl ether, and the like, and mixtures thereof. Suitable glycol ether esters include, for example, propylene glycol methyl ether acetate, propylene glycol n-butyl ether acetate, and the like.

When included, organic solvents are typically used in an amount within the range of 0.5 to 25 wt. %, preferably 1 to 10 wt. %, and more preferably 3 to 8 wt. %.

Other organic solvents suitable for use in hard surface cleaners are well known in the art and have been described for example, in U.S. Pat. Nos. 5,814,590, 6,284,723, 6,399,553, and 6,605,584, and in U.S. Pat. Appl. Publ. No. 2010/0184855, the teachings of which are incorporated herein by reference.

Other Components

The hard surface cleaner can include additional conventional components. Commonly, the cleaners include one or more additives such as builders, buffers, abrasives, electrolytes, bleaching agents, fragrances, dyes, foaming control agents, antimicrobial agents, thickeners, pigments, gloss enhancers, enzymes, detergents, surfactants, cosolvents, dispersants, polymers, silicones, hydrotropes, and the like.

The invention includes a method for removing permanent ink from a hard surface. The method comprises applying to the hard surface a cleaner composition of the invention as described hereinabove, and then removing the used cleaner composition from the cleaned hard surface by any suitable means, such as wiping with a paper towel or cloth. For removal of the used cleaner, it may suffice to simply spray the cleaner onto a tilted or vertical hard surface and allow the liquid to drain and evaporate from the surface.

Concentrates

In another aspect, the invention relates to a dilutable hard surface cleaner concentrate. The concentrate comprises 1 to 50 wt. % of a monoterpene; 1 to 50 wt. % of a $C_{10}$-$C_{17}$ fatty acid derivative selected from N,N-dialkyl amides, N,N-dialkyl esteramines, and N,N-dialkyl amidoamines; and 1 to 50 wt. % of one or more surfactants selected from anionic, cationic, nonionic, and amphoteric surfactants. Suitable monoterpenes, fatty acid derivatives, and surfactants have already been described. Preferably, the concentrates further comprise a minimum amount of water needed to solubilize the other components. Preferably, the amount of water used is within the range of 1 to 20 wt. %, more preferably from 1 to 10 wt. %. The formulator or even the ultimate customer may dilute the concentrate with water for normal use.

Graffiti Removers

In another aspect, the invention relates to graffiti removers comprising the inventive aqueous hard surface cleaners or concentrates. Preferred compositions are simply the aqueous cleaners described above. Effective water-based graffiti removers are generally unknown in the art. It may be desirable, however, to include other organic solvents (e.g., glycol ethers, N-methyl-2-pyrrolidone, or the like), thixotropic agents, dye bleaching agents, or other components in these compositions as is discussed in U.S. Pat. Nos. 5,346,640; 5,712,234; 5,773,091; and 6,797,684, the teachings of which are incorporated herein by reference. In some cases, the graffiti remover will utilize the inventive concentrates and may contain a high proportion of organic solvent. Graffiti removers of the invention should be particularly effective in removing graffiti created with permanent marker, including black permanent marker.

Other Applications

In another aspect, the invention relates to a permanent marker having an attached or built-in "eraser" that utilizes the aqueous hard surface cleaner or concentrate discussed above. The eraser could be designed to dispense a small amount of fluid under pressure to decolorize unintended permanent marks. The skilled person will envision other similar possibilities, such as a stand-alone "correction pen" having a reservoir that contains the inventive cleaner or concentrate. This could be used to "draw" over permanent ink markings to erase the ink. Also contemplated are "correction fluids" that could be applied by a pen or brush to remove permanent marker from hard surfaces. Such a fluid might be valuable for removing permanent ink used accidentally (or even intentionally) on a dry-erase whiteboard, for example.

The following examples merely illustrate the invention. Those skilled in the art will recognize many variations that are within the spirit of the invention and scope of the claims.

Feedstock Syntheses

Preparation of Methyl 9-Decenoate ("C10-0") and Methyl 9-Dodecenoate ("C12-0")

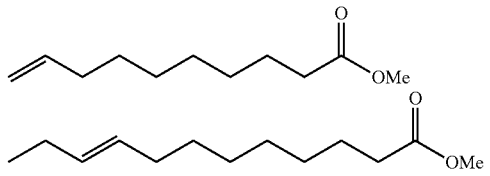

The procedures of U.S. Pat. Appl. Publ. No. 2011/0113679, the teachings of which are incorporated herein by reference, are used to generate feedstocks C10-0 and C12-0 as follows:

Example 1A: Cross-Metathesis of Soybean Oil and 1-Butene

A clean, dry, stainless-steel jacketed 5-gallon Parr reactor equipped with a dip tube, overhead stirrer, internal cooling/heating coils, temperature probe, sampling valve, and relief valve is purged with argon to 15 psig. Soybean oil (SBO, 2.5 kg, 2.9 mol, Costco, $M_n$=864.4 g/mol, 85 weight % unsaturation, sparged with argon in a 5-gal container for 1 h) is added to the Parr reactor. The reactor is sealed, and the SBO is purged with argon for 2 h while cooling to 10° C. After 2 h, the reactor is vented to 10 psig. The dip tube valve is connected to a 1-butene cylinder (Airgas, CP grade, 33 psig headspace pressure, >99 wt. %) and re-pressurized to 15 psig with 1-butene. The reactor is again vented to 10 psig to remove residual argon. The SBO is stirred at 350 rpm and 9-15° C. under 18-28 psig 1-butene until 3 mol 1-butene per SBO olefin bond are transferred into the reactor (~2.2 kg 1-butene over 4-5 h).

A toluene solution of [1,3-bis-(2,4,6-trimethylphenyl)-2-imidazolidinylidene]-dichlororuthenium(3-methyl-2-butenylidene)(tricyclohexylphosphine) (C827, Materia) is prepared in a Fischer-Porter pressure vessel by dissolving 130 mg catalyst in 30 g of toluene (10 mol ppm per mol olefin bond of SBO). The catalyst mixture is added to the reactor via the reactor dip tube by pressurizing the headspace inside the Fischer-Porter vessel with argon to 50-60 psig. The Fischer-Porter vessel and dip tube are rinsed with additional toluene (30 g). The reaction mixture is stirred for 2.0 h at 60° C. and is then allowed to cool to ambient temperature while the gases in the headspace are vented.

After the pressure is released, the reaction mixture is transferred to a round-bottom flask containing bleaching clay (Pure-Flo® B80 CG clay, product of Oil-Dri Corporation of America, 2% w/w SBO, 58 g) and a magnetic stir bar. The reaction mixture is stirred at 85° C. under argon. After 2 h, during which time any remaining 1-butene is allowed to vent, the reaction mixture cools to 40° C. and is filtered through a glass frit. An aliquot of the product mixture is transesterified with 1% w/w NaOMe in methanol at 60° C. By gas chromatography (GC), it contains: methyl 9-decenoate (22 wt. %), methyl 9-dodecenoate (16 wt. %), dimethyl 9-octadecenedioate (3 wt. %), and methyl 9-octadecenoate (3 wt. %).

The results compare favorably with calculated yields for a hypothetical equilibrium mixture: methyl 9-decenoate (23.4 wt. %), methyl 9-dodecenoate (17.9 wt/%), dimethyl 9-octadecenedioate (3.7 wt. %), and methyl 9-octadecenoate (1.8 wt. %).

Example 1B

The procedure of Example 1A is generally followed with 1.73 kg SBO and 3 mol 1-butene/SBO double bond. An aliquot of the product mixture is transesterified with sodium methoxide in methanol as described above. The products (by GC) are: methyl 9-decenoate (24 wt. %), methyl 9-dodecenoate (18 wt. %), dimethyl 9-octadecenedioate (2 wt. %), and methyl 9-octadecenoate (2 wt. %).

Example 1C

The procedure of Example 1A is generally followed with 1.75 kg SBO and 3 mol 1-butene/SBO double bond. An aliquot of the product mixture is transesterified with sodium methoxide in methanol as described above. The products (by GC) are: methyl 9-decenoate (24 wt. %), methyl 9-dodecenoate (17 wt. %), dimethyl 9-octadecenedioate (3 wt. %), and methyl 9-octadecenoate (2 wt. %).

Example 1D

The procedure of Example 1A is generally followed with 2.2 kg SBO and 3 mol 1-butene/SBO double bond. Additionally, the toluene used to transfer the catalyst (60 g) is replaced with SBO. An aliquot of the product mixture is transesterified with sodium methoxide in methanol as described above. The products (by GC) are: methyl 9-decenoate (25 wt. %), methyl 9-dodecenoate (18 wt. %), dimethyl 9-octadecenedioate (3 wt. %), and methyl 9-octadecenoate (1 wt. %).

Example 1E. Separation of Olefins from Modified Triglyceride

A 12-L round-bottom flask equipped with a magnetic stir bar, heating mantle, and temperature controller is charged with the combined reaction products from Examples 1A-1D (8.42 kg). A cooling condenser with a vacuum inlet is attached to the middle neck of the flask and a receiving flask is connected to the condenser. Volatile hydrocarbons (olefins) are removed from the reaction product by vacuum distillation. Pot temperature: 22° C.-130° C.; distillation head temperature: 19° C.-70° C.; pressure: 2000-160 μtorr. After removing the volatile hydrocarbons, 5.34 kg of non-volatile residue remains. An aliquot of the non-volatile product mixture is transesterified with sodium methoxide in methanol as described above. The products (by GC) are: methyl 9-decenoate (32 wt. %), methyl 9-dodecenoate (23 wt. %), dimethyl 9-octadecenedioate (4 wt. %), and methyl 9-octadecenoate (5 wt. %). This mixture is also called "UTG-0." (An analogous product made from palm oil is called "PUTG-0.")

Example 1F. Methanolysls of Modified Triglyceride

A 12-L round-bottom flask fitted with a magnetic stir bar, condenser, heating mantle, temperature probe, and gas adapter is charged with sodium methoxide in methanol (1% w/w, 4.0 L) and the non-volatile product mixture produced in Example 1E (5.34 kg). The resulting light-yellow heterogeneous mixture is stirred at 60° C. After 1 h, the mixture turns homogeneous and has an orange color (pH=11). After 2 h of reaction, the mixture is cooled to ambient temperature and two layers form. The organic phase is washed with aqueous methanol (50% v/v, 2×3 L), separated, and neutralized by washing with glacial acetic acid in methanol (1 mol HOAc/mol NaOMe) to pH=6.5. Yield: 5.03 kg.

Example 1G. Isolation of Methyl Ester Feedstocks

A 12-L round-bottom flask fitted with a magnetic stirrer, packed column, and temperature controller is charged with the methyl ester mixture produced in example 1F (5.03 kg), and the flask is placed in a heating mantle. The glass column is 2"×36" and contains 0.16" Pro-Pak™ stainless-steel saddles (Cannon Instrument Co.). The column is attached to a fractional distillation head to which a 1-L pre-weighed flask is fitted for collecting fractions. Distillation is performed under vacuum (100-120 μtorr). A reflux ratio of 1:3 is used to isolate methyl 9-decenoate ("C10-0") and methyl 9-dodecenoate ("C12-0"). Samples collected during the distillation, distillation conditions, and the composition of the fractions (by GC) are shown in Table 1. A reflux ratio of 1:3 refers to 1 drop collected for every 3 drops sent back to the distillation column. Combining appropriate fractions yields methyl 9-decenoate (1.46 kg, 99.7% pure) and methyl 9-dodecenoate (0.55 kg, >98% pure).

Feedstock C14-0 is made by a procedure analogous to the one used to produce C12-0 except that 1-hexene is used as a cross-metathesis reactant instead of 1-butene.

TABLE 1

Isolation of C10-0 and C12-0 by Distillation

| Distillation Fractions # | Head temp. (° C.) | Pot temp. (° C.) | Vacuum (μtorr) | Weight (g) | C10-0 (wt %) | C12-0 (wt %) |
|---|---|---|---|---|---|---|
| 1 | 40-47 | 104-106 | 110 | 6.8 | 80 | 0 |
| 2 | 45-46 | 106 | 110 | 32.4 | 99 | 0 |
| 3 | 47-48 | 105-110 | 120 | 223.6 | 99 | 0 |
| 4 | 49-50 | 110-112 | 120 | 283 | 99 | 0 |
| 5 | 50 | 106 | 110 | 555 | 99 | 0 |
| 6 | 50 | 108 | 110 | 264 | 99 | 0 |
| 7 | 50 | 112 | 110 | 171 | 99 | 0 |
| 8 | 51 | 114 | 110 | 76 | 97 | 1 |
| 9 | 65-70 | 126-128 | 110 | 87 | 47 | 23 |
| 10 | 74 | 130-131 | 110 | 64 | 0 | 75 |
| 11 | 75 | 133 | 110 | 52.3 | 0 | 74 |
| 12 | 76 | 135-136 | 110 | 38 | 0 | 79 |
| 13 | 76 | 136-138 | 100 | 52.4 | 0 | 90 |
| 14 | 76 | 138-139 | 100 | 25.5 | 0 | 85 |
| 15 | 76-77 | 140 | 110 | 123 | 0 | 98 |
| 16 | 78 | 140 | 100 | 426 | 0 | 100 |

Preparation of Fatty Acids from Methyl Esters

Methyl esters C10-0, C12-0, and C14-0 are converted to their respective fatty acids (e.g., C10-36 and C12-39) as follows.

Potassium hydroxide/glycerin solution (16-17 wt. % KOH) is added to a flask equipped with an overhead stirrer, thermocouple, and nitrogen sparge, and the solution is heated to ~100° C. The methyl ester is then added to the KOH/glycerine solution. An excess of KOH (2-4 moles KOH per mole of methyl ester) is used; for monoesters the mole ratio is about 2, and for diesters about 4. The reaction temperature is raised to 140° C. and heating continues until gas chromatography analysis indicates complete conversion. Deionized water is added so that the weight ratio of reaction mixture to water is about 1.5. The solution is heated to 90° C. to melt any fatty acid salt that may have solidified. Sulfuric acid (30% solution) is added and mixed well to convert the salt to the free fatty acid, and the layers are allowed to separate. The aqueous layer is drained, and the fatty acid layer is washed with water until the aqueous washes are neutral. The crude fatty acids are used "as is" for making the esteramines.

Esteramine Preparation

C10-6: C10 DMEA Ester

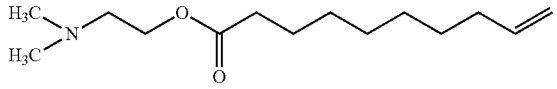

Fatty acid C10-36 (153.7 g, 0.890 mol) and N,N-dimethylethanolamine (142.7 g, 1.60 mol) are charged to a flask equipped with heating mantle, temperature controller, mechanical agitator, nitrogen sparge, five-plate Oldershaw column, and condenser. The mixture is gradually heated to 180° C. while the overhead distillate temperature is kept below 105° C. After the reaction mixture temperature reaches 180° C., it is held at this temperature overnight. Free fatty acid content by $^1$H NMR: 5% (essentially complete). The mixture is cooled to 90° C. and the column, condenser, and nitrogen sparge are removed. Vacuum is applied in increments to 20 mm Hg over ~1 h, held at held at 20 mm Hg for 0.5 h, then improved to full vacuum for 1.5 h. The esteramine product, C10-6, has an unreacted dimethylethanolamine value of 0.41%. Purity is confirmed by a satisfactory $^1$H NMR spectrum.

C12-6: C12 DMEA Ester

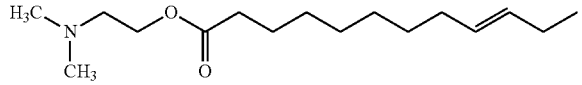

Fatty acid C12-39 (187.2 g, 0.917 mol) and N,N-dimethylethanolamine (147.1 g, 1.65 mol) are charged to a flask equipped with heating mantle, temperature controller, mechanical agitator, nitrogen sparge, five-plate Oldershaw column, and condenser. The mixture is gradually heated to 180° C. while the overhead distillate temperature is kept below 105° C. After the reaction mixture temperature reaches 180° C., it is held at this temperature overnight. Free fatty acid content: 1.59%. The mixture is cooled to 90° C. and the column, condenser, and nitrogen sparge are removed. After the usual vacuum stripping, the esteramine product, C12-6, has an unreacted dimethylethanolamine value of 0.084%. Purity is confirmed by a satisfactory $^1$H NMR spectrum.

C14-3: C14 DMEA Ester

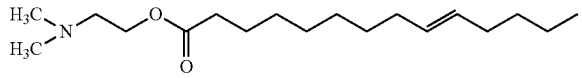

The C14 DMEA ester is prepared analogously to C12-6 starting with the corresponding C14 fatty acid.

Amidoamine Preparation

C10-17: C10 DMAPA Amide

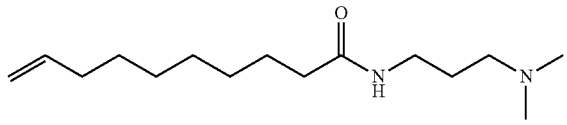

A round-bottom flask is charged with methyl ester C10-0 (500 g), DMAPA (331 g), and sodium methoxide/MeOH solution (0.5 wt. % sodium methoxide based on the amount of methyl ester). The contents are heated slowly to 140° C. and held for 6 h. The reaction mixture is vacuum stripped (11000 to 150° C.). After cooling to room temperature, the product, C10-17, is analyzed. Amine value: 224.1 mg KOH/g; iodine value: 102.6 g $I_2$/100 g sample; titratable amines: 99.94%. $^1$H NMR ($CDCl_3$), δ (ppm): 5.75 ($CH_2$═CH—); 4.9 ($CH_2$═CH—); 3.3 (—C(O)—NH—$CH_2$—); 2.15 (—N$(CH_3)_2$).

C12-17: C12 DMAPA Amide

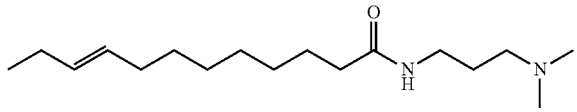

A round-bottom flask is charged with methyl 9-dodecenoate ("C12-0," 670 g). The mixture is stirred mechanically, and DMAPA (387 g) is added. A Dean-Stark trap is fitted to the reactor, and sodium methoxide (30 wt. % solution, 11.2 g) is added. The temperature is raised to 130° C. over 1.5 h, and methanol is collected. After 100 g of distillate is recovered, the temperature is raised to 140° C. and held for 3 h. $^1$H NMR shows complete reaction. The mixture is cooled to room temperature overnight. The mixture is then heated to 110° C. and DMAPA is recovered under vacuum. The temperature is slowly raised to 150° C. over 1.5 h and held at 150° C. for 1 h. The product, amidoamine C12-17, is cooled to room temperature. Amine value: 202.1 mg KOH/g; iodine value: 89.5 g $I_2$/100 g sample; free DMAPA: 0.43%; titratable amines; 100.3%. $^1$H NMR ($CDCl_3$), δ: 5.4 (—CH═CH—); 3.3 (—C(O)—NH—$CH_2$—); 2.2 (—N$(CH_3)_2$).

Dialkyl Amide Preparation

C10-25: C10 DMA Amide

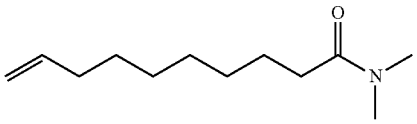

A round-bottom flask is charged with methyl ester feedstock C10-0 (235 g) and the mixture is degassed with nitrogen. Sodium methoxide (5 g of 30% solution in methanol) is added via syringe and the mixture is stirred for 5 min. Dimethylamine (67 g) is slowly added via sub-surface dip tube. After the addition, the mixture is heated to 60° C. and held overnight. The amide, C10-25, is recovered via vacuum distillation (120° C., 20 mm Hg). Yield: 241.2 g (96.3%). Iodine value=128.9 g $I_2$/100 g sample. $^1$H NMR ($CDCl_3$), δ (ppm)=5.8 ($CH_2$═CH—); 4.9 ($CH_2$═CH—); 2.8-3.0 (—C(O)—N$(CH_3)_2$); 2.25 (—$CH_2$—C(O)—). Ester content (by $^1$H NMR): 0.54%.

C12-25: C12 DMA Amide

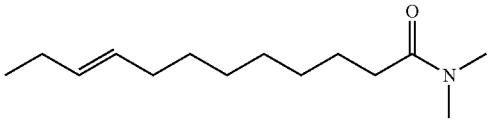

A round-bottom flask is charged with methyl ester feedstock C12-0 (900.0 g, 4.22 mol) and the material is heated to 60° C. The reactor is sealed and vacuum is applied for 0.5 h to dry/degas the feedstock. The reactor is backfilled with nitrogen, and then sodium methoxide (30 g of 30% solution in methanol) is added via syringe. A static vacuum (−30" Hg) is established, and then dimethylamine ("DMA," 190.3 g, 4.22 mol) is slowly added via sub-surface dip tube. When the pressure equalizes, the reactor is opened to nitrogen overhead and the temperature is increased 70° C. for 1.0 h. The reactor is then cooled to room temperature and the DMA addition is discontinued. Heating resumes to 80° C. and DMA is slowly introduced via sub-surface sparge and held for 2.0 h. The temperature is then increased to 90° C. and held for 1.0 h. $^1$H NMR spectroscopy indicates >98% conversion. The mixture is cooled to 75° C. and full vacuum is applied to strip methanol and excess DMA. The catalyst is quenched by adding 50% aqueous sulfuric acid (16.3 g) and the mixture is stirred vigorously for 10 min. Deionized water (200 mL) is added and all of the contents are transferred to a bottom-draining vessel. The aqueous layer is removed. The wash is repeated with 300 mL and then 150 mL of deionized water. Approximately 50 mL of 20% NaCl solution is added and the mixture settles overnight. The lower layer is removed and the product is transferred back to the reactor. The product is heated to 75° C. and vacuum is applied to remove residual water. The amide is recovered by vacuum distillation at 120° 0. The amide fraction is placed under full vacuum at 135° C. until the ester content is below 1%. Final ester content: 0.7%. Yield: 875 g (91.9%).

C14-8: C14 DMA Amide

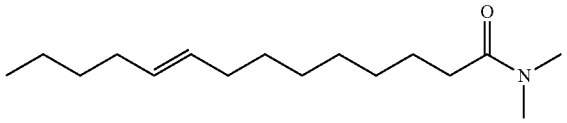

The C14 DMA amide is prepared analogously to C12-25 starting with the corresponding C14 methyl ester feedstock.

Amine Oxide Preparation:

C10-38: C10 Amine

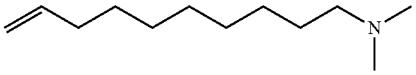

Amide C10-25 (475 g) is slowly added over 3 h to a stirring THF slurry of $LiAlH_4$ (59.4 g) under nitrogen while maintaining the temperature at 11-15° C. The mixture warms to room temperature and stirs overnight. The mixture is chilled in an ice bath, and water (60 g) is added cautiously, followed by 15% aq. NaOH solution (60 g) and then additional water (180 g) is added. The mixture warms to room temperature and is stirred for 1 h. The mixture is filtered, and the filter cake is washed with THF. The filtrates are combined and concentrated. NMR analysis of the crude product indicates that it contains approximately 16% 9-decen-1-ol, a side-product formed during the reduction of the amide. In order to sequester the alcohol, phthalic anhydride is to be added, thus forming the half-ester/acid. The product mixture is heated to 60° C. and phthalic anhydride (57.5 g) is added in portions. NMR analysis of the mixture shows complete consumption of the alcohol, and the mixture is vacuum distilled to isolate C10-38. Amine value: 298.0 mg KOH/g; iodine value: 143.15 g $I_2$/100 g sample; % moisture: 0.02%. $^1$H NMR ($CDCl_3$), δ (ppm): 5.8 ($CH_2$═CH—); 4.9 ($CH_2$═CH—); 3.7 (—$CH_2$—N$(CH_3)_2$).

C10-39: C10 Amine Oxide

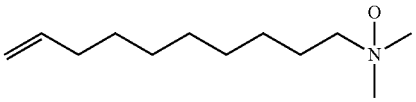

A round-bottom flask is charged with amine C10-38 (136 g), water (223 g), and Hamp-Ex 80 (pentasodium diethylenetriamine pentaacetate solution, 0.4 g). The mixture is heated to 50° C. and dry ice is added until the pH is ~7.0. When the pH stabilizes, hydrogen peroxide (35% solution, 73.5 g) is added dropwise, and the ensuing exotherm is allowed to heat the mixture to 75° C. When the peroxide addition is complete, the mixture is maintained at 75° C. for 18 h. Stirring continues at 75° C. until the residual peroxide level is <0.2%. $^1$H NMR analysis indicates a complete reaction, and the solution is cooled to room temperature to give amine oxide C10-39. Residual peroxide: 0.13%; free tertiary amine: 0.63%; amine oxide: 32.6%.

Aqueous Hard Surface Cleaners

All-purpose aqueous cleaners are formulated by combining water, sodium carbonate, an anionic surfactant (Biosoft® D-40, sodium dodecylbenzene sulfonate, 40% actives, product of Stepan Company), a nonionic surfactant (Biosoft® N91-6, $C_9$-$C_{11}$ alcohol 6EO ethoxylate, product of Stepan), a terpene (lemon oil or d-limonene), and a fatty N,N-dialkyl amide in the amounts indicated in Table 2 and mixing to obtain a clear, homogeneous solution.

To test the cleaners, the word "Test" is written twice (about 10 inches apart) with a black Sharpie permanent marker on a desktop. Test and control formulations are sprayed on the surface, and changes in the appearance of the marking are noted as a function of time.

The inventive compositions with lemon oil or d-limonene plus an amide cause the marking to fade, usually within 2 minutes depending on the composition. The control formulation (Comparative Example 5), with propylene glycol n-butyl ether instead of the amide, shows little or no change after 5 minutes of contact time. Fastest decoloration of the permanent mark is achieved when a base (e.g., sodium carbonate) is used (see Example 1 versus Example 4) and when a metathesis-based unsaturated amide is used rather than the commercial saturated amide mixture, Steposol® M-8-10 (Example 1 versus Example 3).

TABLE 2

Performance of Hard Surface Cleaners on Black Permanent Marker

| Example | 1 | 2 | 3 | 4 | C5* |
|---|---|---|---|---|---|
| Lemon oil | 0.5 | — | 0.5 | 0.5 | 0.5 |
| d-Limonene | — | 0.5 | — | — | — |
| C10-25 amide | 0.5 | 0.5 | — | 0.5 | — |
| Steposol ® M-8-10 | — | — | 0.5 | — | — |
| Dowanol ® PnB | — | — | — | — | 0.5 |
| Sodium carbonate | 0.2 | 0.2 | 0.2 | — | 0.2 |
| Sodium citrate | — | — | — | 0.2 | — |
| Biosoft ® N91-6 | 0.4 | 0.4 | 0.4 | 0.4 | 0.4 |
| Biosoft ® D-40 | 1.0 | 1.0 | 1.0 | 1.0 | 1.0 |
| Water | q.s. to 100 | q.s. to 100 | q.s. to 100 | q.s. to 100 | q.s. to 100 |

TABLE 2-continued

Performance of Hard Surface Cleaners on Black Permanent Marker

| Example | 1 | 2 | 3 | 4 | C5* |
|---|---|---|---|---|---|
| % Fade, 2 min | 50 | 20 | — | — | — |
| % Fade, 3 min | 90+ | 80 | — | — | — |
| % Fade, 5 min | 90+ | — | 85 | 30 | 0 |

Steposol ® M-8-10 is N,N-dimethyl capramide/N,N-dimethyl caprylamide mixture, product of Stepan Dowanol ® PnB = propylene glycol n-butyl ether, product of Dow Chemical Biosoft ® N91-6 is a $C_9$-$C_{11}$ alcohol 6 EO ethoxylate, product of Stepan.

Biosoft ® D-40 is sodium dodecylbenzene sulfonate, 40% actives, product of Stepan.

*Comparative example

Modified Commercial Lemon-Scented Cleaners

In another series of experiments, summarized in Table 3, a commercial lemon-scented all-purpose cleaner is modified by adding various amine-functional derivatives (0.6% actives) to the citrus component already present in the cleaner. Thus, a 20-g sample of the commercial lemon-scented all-purpose cleaner is combined with 0.12 g of 100% actives material, and this mixture is tested as described above on black permanent ink markings on a desktop. The results are compared with those of a control formulation consisting of the commercial cleaner with no amine-functional derivative added.

As Table 3 shows, with the commercial cleaner alone, there is no decolorization of the permanent mark after four minutes. In stark contrast, C10-25, the metathesis-derived unsaturated amide, rapidly decolorizes the mark within one minute (Examples 6 and 7). Other amine-functional derivatives tested (DMEA ester C14-3 and dimethyl amide C14-8; see Examples 8-10), are slower to decolorize the mark, but still decolorize it within four minutes. The DMAPA amide (C12-17, Example 11) is less effective, but it is still able to decolorize the mark somewhat within four minutes. Comparative Example 12 shows that a metathesis-based C10 unsaturated amine oxide performs equal to the control, i.e., it is ineffective in decolorizing the permanent mark within four minutes.

TABLE 3

Performance of Modified Commercial Lemon-Scented All-Purpose Cleaner on Black Permanent Marker

| | | Example | | | | | | |
|---|---|---|---|---|---|---|---|---|
| Commercial all-purpose cleaner | control | 6 | 7 | 8 | 9 | 10 | 11 | C12* |
| + C10-25 amide, % active | | 0.6 | 0.6 | — | — | — | — | — |
| + C14-3 DMEA ester, % active | | — | — | 0.6 | 0.6 | — | — | — |
| + C14-8 amide, % active | | — | — | — | — | 0.6 | — | — |
| + C12-17 DMAPA amide, % active | | — | — | — | — | — | 0.6 | — |
| + C10-39 amine oxide, % active | | — | — | — | — | — | — | 0.6 |
| % Fade, 1 min. | 0 | 90+ | — | 10 | — | 70 | — | 0 |
| % Fade, 2 min. | 0 | — | 90+ | — | 50 | — | 10 | — |
| % Fade, 3 min. | 0 | 90+ | — | 90+ | — | 90+ | — | 0 |
| % Fade, 4 min. | 0 | — | 90+ | — | 90+ | — | 30 | — |

Formulations produced by combining 0.12 g of 100% actives material with 20 g of a commercial lemon-scented all-purpose cleaner.

% Fade is a visually estimated % removal of permanent mark.

*Comparative example

Modified Lab Antibacterial Cleaners

A lab-based antibacterial all-purpose cleaner is prepared from the formulation shown in Table 4. This is used as the control for tests in which C10-25 (at 0.5% actives), the metathesis-based unsaturated dimethyl amide, is used in combination with pine oil, lavender oil, or almond oil (each at 0.6% actives). Comparative Examples 13 and 14 show that neither the amide alone nor pine oil alone is able to decolorize the permanent mark. In contrast, the combination of C10-25 and pine oil fades most of the mark by the 4 minute mark. Although the result is less dramatic with pine oil compared with lemon oil, decolorization is achieved. Lavender oil and almond oil are even slower, but an improvement over the control formulation is evident.

TABLE 4

Performance of a Modified Lab Antibacterial All-Purpose Cleaner on Black Permanent Marker

| Base Formulation (g): | control |
|---|---|
| Ammonyx ® LMDO (33% actives) | 30.3 |
| Versene ™ K4EDTA chelant (38% actives) | 5.26 |
| BTC ® 835 (50% actives) | 6.00 |
| Monoethanolamine | 5.00 |
| Dowanol ® PnP | 15.0 |
| Water | 938.4 |

| | | Example | | | | | |
|---|---|---|---|---|---|---|---|
| | control | C13* | C14* | 15 | 16 | 17 | 18 |
| C10-25 amide, % active | 0 | 0.5 | 0 | 0.5 | 0.5 | 0.5 | 0.5 |
| pine oil, % active | 0 | 0 | 0.6 | 0.6 | 0.6 | 0 | 0 |
| lavender oil, % active | 0 | 0 | 0 | 0 | 0 | 0.6 | 0 |
| almond oil, % active | 0 | 0 | 0 | 0 | 0 | 0 | 0.6 |
| % Fade, 2 min. | 0 | 0 | — | 20 | — | — | — |
| % Fade, 3 min. | 0 | — | 0 | — | 60 | — | — |
| % Fade, 4 min. | 0 | 0 | — | 75 | — | 35 | 25 |

Ammonyx ® LMDO (lauryl/myristyl amidopropyldimethyl amine oxide) is a product of Stepan.
Versene ™ K4EDTA (tetrapotassium EDTA) is a product of Dow Chemical.
BTC ® 835 (alkyl dimethylbenzyl ammonium chloride) is a product of Stepan.
Dowanol ® PnP (propylene glycol n-propyl ether) is a product of Dow Chemical
% Fade is visually estimated % removal of permanent mark.
*Comparative example The preceding examples are meant only as illustrations. The following claims define the invention.

We claim:

1. An aqueous hard surface cleaner consisting of:
(a) 75 to 99 wt. % of water;
(b) 0.1 to 5 wt. % of a monoterpene selected from the group consisting of limonene, α-pinene, μ-pinene, carene, α-terpinene, γ-terpinene, α-terpineol, camphene, p-cymene, myrcene, and mixtures thereof;
(c) 0.1 to 5 wt. % of a $C_{10}$-$C_{14}$ N,N-dimethyl amide; and
(d) 0.1 to 5 wt. % of one or more surfactants selected from the group consisting of anionic, cationic, nonionic, and amphoteric surfactants;
wherein the anionic surfactant is selected from the group consisting of alkyl sulfates, alkyl ether sulfates, olefin sulfonates, α-sulfonated alkyl esters, α-sulfonated alkyl carboxylates, alkyl aryl sulfonates, sulfoacetates, sulfosuccinates, alkane sulfonates, and alkylphenol alkoxylate sulfates, and mixtures thereof;
(e) 0.1 to 5 wt. % of an alkali metal carbonate;
(f) optionally, 0.5 to 25 wt. % of a water-soluble organic solvent; and
(g) optionally, one or more additives selected from the group consisting of builders, buffers, abrasives, electrolytes, bleaching agents, dyes, foaming control agents, antimicrobial agents, thickeners, pigments, gloss enhancers, enzymes, silicones, and hydrotropes.

2. The cleaner of claim 1 wherein the surfactant is a mixture of an anionic surfactant and a nonionic surfactant.

3. The cleaner of claim 1 wherein the alkali metal carbonate is sodium carbonate.

4. The cleaner of claim 1 wherein the $C_{10}$-$C_{14}$ N,N-dimethyl amide is monounsaturated.

5. The cleaner of claim 4 wherein the monounsaturated $C_{10}$-$C_{14}$ N,N-dimethyl amide has at least 1 mole % of trans-$\Delta^9$ unsaturation.

6. The cleaner of claim 1 wherein the $C_{10}$-$C_{14}$ N,N-dimethyl amide is a monounsaturated $C_{10}$-$C_{12}$ N,N-dimethyl amide.

7. The cleaner of claim 1 wherein the $C_{10}$-$C_{14}$ N,N-dimethyl amide has the structure:

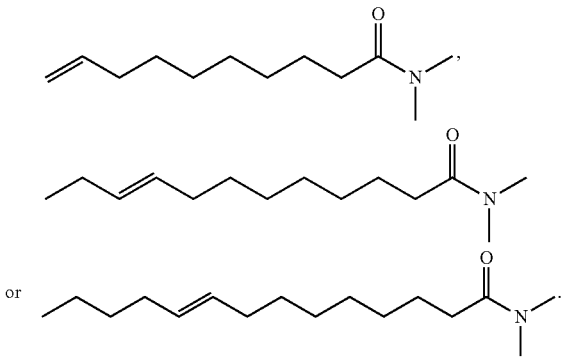

8. A method for removing permanent ink from a hard surface, comprising applying to the hard surface the cleaner of claim 1 and removing the used cleaner from the cleaned hard surface.

9. A dilutable hard-surface cleaner concentrate comprising:
(a) 1 to 50 wt. % of a monoterpene selected from the group consisting of limonene, α-pinene, μ-pinene, carene, α-terpinene, γ-terpinene, α-terpineol, camphene, p-cymene, myrcene, and mixtures thereof;
(b) 1 to 50 wt. % of a $C_{10}$-$C_{14}$ N,N-dimethyl amide; and
(c) 1 to 50 wt. % of one or more surfactants selected from the group consisting of anionic, cationic, nonionic, and amphoteric surfactants;
wherein the anionic surfactant is selected from the group consisting of alkyl sulfates, alkyl ether sulfates, olefin sulfonates, α-sulfonated alkyl esters, α-sulfonated alkyl carboxylates, alkyl aryl sulfonates, sulfoacetates, sulfosuccinates, alkane sulfonates, and alkylphenol alkoxylate sulfates, and mixtures thereof;
(d) 0.1 to 5 wt. % of an alkali metal carbonate;
(e) optionally, 0.5 to 25 wt. % of a water-soluble organic solvent; and
(f) optionally, one or more additives selected from the group consisting of builders, buffers, abrasives, electrolytes, bleaching agents, dyes, foaming control agents, antimicrobial agents, thickeners, pigments, gloss enhancers, enzymes, silicones, and hydrotropes.

10. The concentrate of claim 9 wherein the $C_{10}$-$C_{14}$ N,N-dimethyl amide is monounsaturated.

11. The concentrate of claim 10 wherein the $C_{10}$-$C_{14}$ N,N-dimethyl amide is a monounsaturated $C_{10}$-$C_{12}$ N,N-dimethyl amide.

12. The concentrate of claim 9 wherein the $C_{10}$-$C_{14}$ N,N-dimethyl amide has the structure:

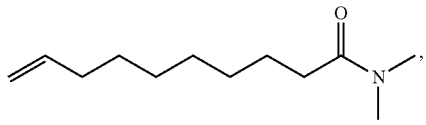

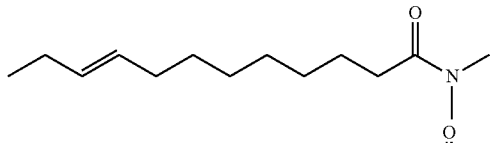

or

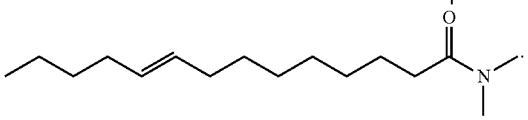

13. The cleaner of claim 1 wherein the cleaner is used as a graffiti remover.

14. A graffiti remover comprising the concentrate of claim 9.

15. A permanent marker having an attached eraser that incorporates the cleaner of claim 1.

16. A permanent marker having an attached eraser that incorporates the concentrate of claim 9.

17. A correction pen having a fluid reservoir incorporating the cleaner of claim 1.

18. A correction pen having a fluid reservoir incorporating the concentrate of claim 9.

19. The cleaner of claim 1 wherein the cleaner is used as a correction fluid.

20. A correction fluid comprising the concentrate of claim 9.

* * * * *